US007004419B2

(12) United States Patent
Hsu

(10) Patent No.: US 7,004,419 B2
(45) Date of Patent: Feb. 28, 2006

(54) APPARATUS FOR PACKING WIRE IN A STORAGE CONTAINER BY USE OF REVERSE WINDING

(75) Inventor: Christopher Hsu, Mentor, OH (US)

(73) Assignee: Lincoln Global, Inc., Cleveland, OH (US)

( * ) Notice: Subject to any disclaimer, the term of this patent is extended or adjusted under 35 U.S.C. 154(b) by 25 days.

(21) Appl. No.: 10/630,305

(22) Filed: Jul. 30, 2003

(65) Prior Publication Data

US 2005/0023401 A1 Feb. 3, 2005

(51) Int. Cl.
*B21C 47/10* (2006.01)
*B21C 47/02* (2006.01)

(52) U.S. Cl. ..... 242/361.4; 242/362

(58) Field of Classification Search ..... 242/361.1, 242/361.4, 361.5, 362, 362.1
See application file for complete search history.

(56) References Cited

U.S. PATENT DOCUMENTS

| | | | | | |
|---|---|---|---|---|---|
| 2,457,094 | A | | 12/1948 | Smith | |
| 2,722,729 | A | * | 11/1955 | Wilhelm | 242/362 |
| 2,849,195 | A | | 8/1958 | Richardson et al. | |
| 2,895,210 | A | | 7/1959 | Hubbard | |
| 2,959,279 | A | * | 11/1960 | Krafft et al. | 242/361.4 |
| 2,966,258 | A | | 12/1960 | Krafft et al. | |
| 3,013,742 | A | | 12/1961 | Bittman | |
| 3,061,229 | A | * | 10/1962 | Jefferson | 242/361.5 |
| 3,076,619 | A | | 2/1963 | Nye et al. | |
| 3,082,868 | A | | 3/1963 | Hubbard | |
| 3,113,745 | A | | 12/1963 | Bittman | |
| 3,120,931 | A | * | 2/1964 | Lorenz | 242/361.4 |
| 3,168,259 | A | | 2/1965 | Cady | |
| 3,235,202 | A | * | 2/1966 | Kitselman | 242/361.4 |
| 3,270,977 | A | * | 9/1966 | Tillou, II | 242/361.4 |
| 3,362,654 | A | * | 1/1968 | Kitselman | 242/361.4 |
| 3,445,077 | A | * | 5/1969 | Cole et al. | 242/361.4 |
| 3,703,261 | A | * | 11/1972 | Cofer et al. | 242/361.4 |
| 3,776,519 | A | * | 12/1973 | Hamilton | 242/362 |
| 3,971,521 | A | * | 7/1976 | Crotti | 242/361.4 |
| 4,350,311 | A | | 9/1982 | Pokhodnya et al. | |
| 4,508,291 | A | | 4/1985 | Kosch | |
| 4,553,707 | A | | 11/1985 | Henrich | |
| 4,869,367 | A | | 9/1989 | Kawasaki et al. | |
| 4,869,438 | A | | 9/1989 | Braun et al. | |
| 5,105,943 | A | | 4/1992 | Lesko et al. | |
| 5,277,314 | A | * | 1/1994 | Cooper et al. | |
| 5,374,005 | A | * | 12/1994 | Jenkins et al. | 242/361.4 |
| 5,494,160 | A | | 2/1996 | Gelmetti | |
| 5,746,380 | A | | 5/1998 | Chung | |
| 5,758,834 | A | * | 6/1998 | Dragoo et al. | |
| 5,806,780 | A | * | 9/1998 | Schneider et al. | |
| 5,819,934 | A | * | 10/1998 | Cooper | |
| 5,897,071 | A | | 4/1999 | Hauck et al. | |
| 6,019,303 | A | * | 2/2000 | Cooper | 242/361.4 |
| 6,260,781 | B1 | * | 7/2001 | Cooper | 242/361.4 |

* cited by examiner

*Primary Examiner*—William A. Rivera
(74) *Attorney, Agent, or Firm*—Fay Sharpe Fagan Minnich & McKee; Brian E. Turung; Robert V. Vickers

(57) ABSTRACT

A method and apparatus for packing welding wire in a storage container to reduce the amount of shifting of the welding wire in the storage container and the number of incidence of tangles (e.g., bird nesting, etc.) occurring during the payout of the welding wire from the storage container. A turntable storage container support that supports the storage container is used to rotate the storage container in a forward and a reverse direction while the welding wire is packed into the storage container.

48 Claims, 9 Drawing Sheets

APPARATUS FOR PACKING WIRE IN A STORAGE CONTAINER BY USE OF REVERSE WINDING

The present invention relates to the art of packing wire into a bulk storage container or storage drum, and more particularly to packing of welding wire in a storage container to improve the payout of a welding wire from the storage container for mass production welding.

BACKGROUND OF THE INVENTION

The present invention is particularly applicable for use in a container of welding wire having a natural "cast" and the invention will be described with particular reference to a natural cast type of welding wire stored as a large wire stack or coils or wire containing convolutions formed into layers of the welding wire which is paid out from the wire stack or coils through the upper portion of the container storing the wire stack or coils. However, the invention has broader applications and may be used with any type of welding wire contained in a wire stack or coils to be fed from the wire stack or coils through the top of the container with or without a tendency to retain a generally straight condition.

Bulk welding wire is commonly packed loosely in large storage containers (e.g., stack of wire in drum or box) or tightly wound on wooden reels. Welding wire that is shipped in large storage containers is often package in a stacked form having a cylindrical inner core. When it is desired to use the wire, a cone assembly is commonly mounted at the top of the container. The cone assembly includes a rotating payout arm extending upwardly from the top of the cone that is provided with an eyelet at its end and a central conduit for guiding the wire to a wire feeder mechanism.

When welding automatically or semi-automatically, it is essential that large amounts of welding wire be continuously directed to the welding operation in a non-twisted, non-distorted non-canted condition so that the welding operation is performed uniformly over long periods of time without manual intervention and/or inspection. It is a tremendously difficult task to be assured that the wire is fed to the welding operation in a non-twisted or low twist condition so that the natural tendency of the wire to seek a preordained natural condition will not be detrimental to smooth and uniform welding.

To accomplish this task, welding wire is produced to have a natural cast, or no-twist or low twist condition. When such wire is wrapped into a wire stack or coils into a large container containing several hundred pounds of the wire for automatic or semi-automatic welding, the natural tendency of the wire makes the wire somewhat live when it is wrapped into an unnatural series of convolutions, distorting the wire from its natural state. Thus, manufacturers produce large containers of welding wire which must be removed from the container without tangling, forming e-scripts and/or introducing unwanted canting into the wire itself.

In automatic and/or semi-automatic welding operations, a tremendous number of robotic welding stations are operable to draw welding wire from a package as a continuous supply of wire to perform successive welding operations. The advent of this mass use of electric welding wire has caused tremendous research and development in improving the packaging for the bulk welding wire. A common package is a drum where looped welding wire is deposited in the drum as a wire stack, or body, of wire having a top surface with an outer cylindrical surface against the drum and an inner cylindrical surface defining a central bore. The central bore is often occupied by a cardboard cylindrical core as shown in Cooper U.S. Pat. No. 5,819,934, which is incorporated herein by reference. It is common practice for the drum to have an upper retainer ring that is used in transportation to stabilize the body of welding wire as it settles. This ring remains on the top of the welding wire to push downward by its weight so the wire can be pulled from the body of wire between the core and the ring. Each loop of wire has one turn of built-in twist so that when it is paid out, the twist introduced by releasing a loop of wire is canceled. Hence the wire is"twist-free" when it reaches the contact tip. The built-in twist causes the wire to spring up from the top of the stack when unrestrained. The weighted ring inhibits or prevents the wire from springing up due to the built-in twist which can result in the wire becoming tangled. Tangles are detrimental to the operation of the package since they cause down time of the robotic welding station. The most common tangle is caused as wire is pulled from the inside of the ring and is referred to as "e-script" because of its shape. E-scripts in the wire can be attributed to several factors such as poor drive roll alignment in the feeder, inconsistent loop diameter, inconsistent fan-out of the loops, settling of the wire during transportation, and abuse in handling the drum of wire. An e-script tangle stops operation of the welder and must be removed. As a result, the tangling of the wire during the paying out of the welding wire results in the welding process having to be stopped, thus resulting in downtime. Such downtime reduces productivity efficiencies and increases production costs. This problem must be solved by manufacturers of welding wire as they sell the welding wire in quantities to be paid out for automatic and semi-automatic welding. This problem is compounded with the trend toward even larger packages with larger stocks of welding wire to thereby reduce the time required for replacement of the supply container at the automatic or semiautomatic welding operation. Consequently, there is an increased demand for a container which is easily adapted to a large capacity and is constructed in a manner such that withdrawing of the welding wire from the container is accomplished smoothly without disturbing the natural flow of the welding wire or twisting the welding wire with adjacent convolutions.

Tangling of the wire can cause interruption of wire flow and drastically interrupt the welding operation. Thus, a large volume, high capacity storage or supply container for welding wire formed in wire stacks or coils must be so constructed that it assures against any catastrophic failure in the feeding of a wire to the welding operation and the container. Further the payout or withdrawing arrangement of the container must be assured that it does not introduce even minor distortions in the free flow of the welding wire to the welding operation. Consequently, there is a substantial demand for a container and withdrawing arrangement for large quantities of welding wire which not only prevents tangling and disruption of the supply of welding wire to the welding operation but also prevents e-script tangles under adverse conditions such as abuse in the handling and poor wire feeder drive roll alignment, together with excellent wire placement consistency and reliable wire-to-tip contact without arc flare.

The welding wire stored in the supply container is commonly in the form of a wire stack or coils having multiple layers of wire convolutions laid from bottom to top, with an inner diameter of the wire stack or coils being substantially smaller than the diameter of the container. Due to the inherent rigidity of the welding wire itself, the convolutions forming the layers are continuously under the influence of a force which tends to widen the diameter of the convolutions.

However, as the welding wire is withdrawn from the container, the loosened wire portion tends to spring up and disturb or become entangled with other looped layers or with itself causing premature pop out of the wire loop to the inside bore, causing the top loop of the wire to move under lower wire loops, causing the wire loop to stretch and extend beyond the outside diameter of the wire stack and thereby fall down the outer periphery of the wire stack, and causing an expanded loop diameter of the wire resulting in the wire popping up above the outer periphery of the retaining ring thereby catching the ring. In such cases, it becomes difficult to withdrawn the wire or feed the wire smoothly. In some of the prior containers, the wire is provided with a preselected twist when inserting the wire into the package in order to prevent torsional deformation of the wire which is being withdrawn axially from the non-rotating container. Consequently, the packaged wire of the wire stack or coils tends to spring up with a greater force. As a result, retainer rings or members are placed on the top of the wire stack or coils to hold the wire in the upper layers in place as it is withdrawn, convolution at a time, from the center opening of the wire stack or coils through the top opening of the supply container.

In the past, substantial effort has been devoted to the prevention of the wire springing up which can result in a feeding error from the container. This feeding error is normally prevented by a center tube of cardboard placed in the wire stack or coils cavity so that all convolutions must be withdrawn from around the center tube. In the prior art, the ring itself contacts the inner surface of the container to prevent convolutions from springing above and around the outside of the retainer ring. In the past, the retainer ring generally rests upon the top of the wire stack or coils by gravity. The suspended float ring assembly is placed on top of the wire in the container to assist in keeping the wire from becoming tangled as it is fed out of the container. The suspended float ring assembly commonly includes an annular metal ring that surrounds the inner core and a plurality of flexible fingers or feathers that extend radially outwardly and slightly upwardly of the ring and into contact with the inner surface of the drum. These fingers, constructed of plastic. The float ring is suspended, that is, it rests freely at the top of the coil of wire in the container. Some of the prior rings have had a series of flat spring steel fingers attached to the retainer ring. These fingers tightly ride against the drum to control the outside convolutions of wire. In some instances, a cardboard ring is cut to the desired shape with a slight interference with the drum wall. This ring is held on the top of the wire stack or coils by a weight which travels down the drum as the wire level is reduced.

All of these arrangements present difficulties. Wire can be tangled on the outside of the ring and substantial drag can be imparted to the wire as it is being paid out or withdrawn from the container. As the wire is removed from the container, a part of the wire coil sprang upwardly and become caught between the float ring and the inner core, or wrap around the core, or forms a knot, thus causing a tangle. Also, the wire above the float ring would sometimes wrap around the inner core, particularly as the float ring assembly descended downwardly as the container emptied.

In an effort to address these problems, an improved retainer ring was developed as disclosed in U.S. Pat. No. 5,277,314. The retainer ring or retainer member included a generally flat outer portion with an outer periphery fitting into a set diameter of the inner wall of the container and had a number of projecting lobe portions whereby the outer periphery of the retainer ring contained alternate areas that were closer to and then farther away from the outer wall of the container when the retainer ring was resting on the upper surface or top of the hollow, cylindrical wire stack or coils of welding wire. The retaining ring also had an inner bell mouthed portion defining an innermost wire extraction opening wherein the convolutions of wire are pulled up through the bell mouthed portion which extended upwardly toward the outlet guide in the top cover or "hat" of the container. The convolutions of wire, as they were pulled from the wire stack or coils, move inwardly toward and into the center cavity of the wire stack or coils and then upwardly through the bell mouth portion toward the exit guide in the container hat. The wire extraction opening defined by the upper end of the bell mouthed portion of the retainer ring included a diameter substantially smaller than the selected diameter of the wire stack or coils itself so that the wire must moved move inwardly before it can move upwardly. By using this bell mouthed concept, the inward movement of the convolutions from the wire stack or coils did not have better support against other convolutions and does not have better support drag along the bottom of the retainer ring as the convolutions from the upper layer were moved inwardly and then upwardly to the outlet guide in the cover or hat of the supply container.

Another prior art retaining ring is disclosed in U.S. Pat. No. 5,758,834. The wire control ring is mounted at the upper part of the inner core and provided with finger and an arrangement that prevents the wire from entering into the space between the ring and the core. The wire control ring has an annular metal ring having an inner diameter which is slightly greater than the outer diameter of the drum's inner core, and an outer diameter which permits the unobstructed removal of wire from the drum. A set of three or four fingers or feathers attached to the ring extend outwardly and slightly upwardly into contact with the inner surface of the drum. The width of these fingers is significantly greater than the width of the prior art feathers to insure that the wire is forced against the inner surface of the drum as it is pulled from the drum and removed. The stiffness of the feathers is such that the wire cannot by itself uncoil and exit the drum, but it not so stiff that the resistance to wire movement from the drum adversely affects the wire feeding process. A diverter member prevents wire from inadvertently entering the space between the ring and the drum's inner core.

Although these retaining rings have reduced the incidence of tangling of the welding wire paid out from a container of welding wire, e-scripts still occur during payout of the welding wire. These e-scripts in the wire can result in non-uniformity of a formed weld bead on a workpiece as the twist in the welding wire is fed through a welding gun. The non-uniform weld bead can result substantial downtime of the welding process in order to untangle the welding wire.

Loosely wound wire in a drum typically results in better wire placement during a welding operation; however, such loosely wound wire is more susceptible to tangling. Tightly wound wire on a reel is more resistant to tangling, but is more likely to result in having wire wobble (poor wire placement) during a welding operation. One reason for the higher incidence of tangling for loosely wound wire is that such loosely wound wire is more susceptible to vibration in normal shipping and handling than tightly wound wire on wooden reels. The wire loops of the loosely wound wire tend to move around during normal transportation to warehouse or customers. The moving or shift of the loosely wound wire in a container also occurs from handling abuse in a warehouse and in a factory wherein the drum is tipped to its side and sometimes laid sideways and rolled despite the warning label. Such improper handling tends to shuffle the wire loops and the original order of laying pattern is disturbed. A full drum of wire is typically not entire full but has head room left for the retainer ring. The drums of welding wire are sold with various weight specifications. Wire of various weights and diameters usually share the same fixed size drums. Therefore the drum must be large enough to accommodate the largest weight and smallest diameter (which has the largest volume) wire. As a result, the head rood in containers of wire varies from product type to product type. During shipping and handling of the container of wire, there is vibration which causes the stack of wire coils to act like a spring. A steel bar positioned in the top of the container and held down by a rubber band to the bottom of the drum is often used to restrain bouncing of the wire stack during shipping and handling. Compressible foam is also used to fill the space between the top of the stack to the drum lid. The use of a steel bar and/or foam remedies are not 100% effective, thus stack bouncing still occurs during transportation and handling. As a result, there is noticeable settling of the wire stack (i.e. up to 5 inches) depending on wire diameter, loop and drum diameter, stack volume, and transportation distance and road condition. Settling of the wire in the container changes the original laying pattern thus resulting in the tangling of the wire as it is paid out of the container. The settling typically has a corkscrew form. Since the wire loops fan out in the same direction from the bottom of the drum all the way to the top, the wire has a natural "slope" for wire loops to corkscrew downward.

One prior art process for filling a storage container with welding wire includes the drawing of the welding wire from a welding wire manufacturing process and feeding the welding wire typically over a series of dancer rollers and to pull the welding wire by a capstan positioned adjacent the storage container. From the capstan, the welding wire is fed into a rotatable laying head, which is generally a cylindrical tube having an opening at the bottom or along the cylinder adjacent to the bottom. The wire extends through the tube and out the opening, whereupon it is placed into the storage container.

The laying head typically extends into the storage container and rotates about an axis generally parallel to the axis of the storage container. The wire being fed into the laying head by the capstan is fed at a rotational velocity different than the rotational velocity of the laying head. The ratio between the rotational velocity of the laying head and the rotational velocity of the capstan determines the loop size diameter of the wire within the storage container. As the wire is laid within the storage container, the weight thereof causes the storage container to gradually move downward. As the storage container moves downward, the laying head continues to rotate, thus filling the storage container to its capacity. The storage container is incrementally rotated in one direction by a fraction of one revolution for each loop of wire being placed within the storage container. This rotation of the storage container causes a tangential portion of the welding wire loop to touch a portion of the inside diameter of the storage container, while the opposite side of the loop is spaced a distance from the side of the storage container. This is accomplished by moving the laying head off the centerline of the storage container by one-half the distance between the loop diameter and the diameter of the storage container.

A typical prior art method of packing a storage container with a welding wire is illustrated in FIG. 1. This method of packing storage containers with welding wire has been somewhat effective in withdrawing welding wire from the storage container during the welding process. However, as illustrated in FIGS. 2 and 3, this packing process can result in a loose density packing of the welding wire within the storage container. Depending on the edge diameter used relative to the storage container, the welding wire has a higher density along the edge portion of the storage container versus the inside diameter of the wire stack itself adjacent the wire stack or coils cavity. This difference in density is caused since more wire is placed along the edge portions of the storage container than is placed along the wire stack or coils cavity. While the net effect results in welding wire being able to be pulled from the storage container without substantial problems with tangles, the low density packing can result in increased tangling of the wire resulting in increased interruptions in the welding process. There is consequently greater downtime for the welding operation, and greater labor costs, since replacement of the supply storage container at the welding operation and manual intervention in the welding operation is necessary. In addition, the loose packing of the wire can result in the wire shifting during movement or shipment of the storage container, which shifting of the welding wire can result in disorder of the wire loops which can result in tangling of the welding wire in the storage container. These wire shifting can result in an outside ring tangle where wire loop pops up in the clearance between drum inner diameter and outside periphery of the retainer ring, an e-script tangle wherein the excess wire length between the inner diameter of the retainer ring and exit hole of the hat forms a knot, wire loop expansion beyond the periphery of the wire stack resulting in the wire loops cascading down the clearance between the outside periphery of wire stack and drum inner diameter, and/or birdnests from multiple loops of wire being pulled out at the same time. As a result, such wire shifting can result in payout stoppage of the welding wire from the storage container, which in turn results in the welding operation having to terminate to correct the payout problem.

One prior art packing arrangement is set forth in Assignee's U.S. Pat. No. 6,260,781. In this patent, a method for densely packing welding wire in a storage container is disclosed. The packing involves the use of an indexing apparatus which allows the storage container and rotatable head to be moved relative to the other in sequential steps during packing of the wire within the storage container. The indexer causes a rotatable laying head to place wire in the storage container from a different position within the storage container, thereby allowing for a more dense packing of the welding wire within the storage container. In addition to using the indexer, the loop diameter of the wire within the storage container can be varied, thus resulting in the production of striated layers of welding wire within the storage container, each layer having a maximum density at a different radial position within the storage container than the adjacent layer. In essence, the indexing step and/or the changing of loop diameter helps to ensure that a storage container of welding wire is more densely packed than previous packing arrangements, thus enabling more welding wire to be placed within the same volume storage container. Although the novel wrapping arrangement disclosed in the '781 patent increases the volume of wire which can be packed into a storage container, the packing arrangement is still not immune to problems of the welding wire shifting during the transport and shipment of the storage container of welding wire from one location to the next. This shifting of the welding wire within the storage container increases the incidence of bird nests forming during the payout of the welding wire from the storage container.

In view of the present state of the prior art for the packaging of welding wire in storage containers, there remains a need for a packaging process which allows for the uninterrupted payout of the welding wire from the storage container, and which packaging arrangement reduces the tendency of the welding wire to shift within the storage container during shipment of the storage container which shifting can result in undesired tangles in the welding wire during pay out from the storage container.

SUMMARY OF THE INVENTION

The present invention provides an improved method and apparatus of packing welding wire in a storage container, which overcomes the disadvantages of the prior art method and apparatus arrangements. Although the invention is particularly directed to the packing of welding wire in a storage container and will be described with particular reference thereto, it will be appreciated that the process, method and apparatus of the present invention can be used to pack other types of wire into a storage container. The invention is used to package welding wire in storage containers without affecting the ability to smoothly and quickly withdraw the welding wire from the storage container during automatic or semiautomatic welding processes. In addition, the invention is used to package welding wire in the storage containers in a manner which results in a reduced amount of shifting of the welding wire within the storage container when the storage container is transported from location to location. This reduction in the shifting of the welding wire in turn reduces the tendency of the welding wire to become tangled in the storage container, and/or to shift into a position which would result in increased incidence of bird nesting of the welding wire as the welding wire is being paid out from the storage container. The invention is particularly directed to the packing of welding wire and to a storage container that is packed in a certain manner with welding wire and will be described with particular reference thereto; however, it can be appreciated that the invention has much broader applications and can be used to package and store in a storage container a wide variety of welding wires other than welding wire.

In one aspect of the present invention, a packing machine used to pack the welding wire within a welding wire storage container includes a capstan that pulls the welding wire that has generally just been formed by a welding wire drawing benches. The welding wire from the welding wire manufacturing process is typically a solid welding wire or a cored welding wire, which cored welding wire includes fluxing and/or alloying materials. The packing machine also includes a rotatable laying head upon a first axis for receiving the welding wire from the capstan, and a turntable which supports a welding wire storage container. The welding wire is packaged within the storage container by rotating the laying head at a first rotational velocity and rotating the capstan at a second rotational velocity in order to determine the loop diameter of the welding wire which is being laid within the storage container. The turntable upon which the storage container rests is rotated about an axis which is typically parallel to the first axis of rotation of the rotatable laying head. Generally, for each loop welding wire placed within the storage container, the turntable rotates in a manner such that only a small portion of the circumference of the loop of the welding wire contacts the inner surface of the storage container. By rotating the turntable in such a manner, it is ensured that a subsequent loop placed within the storage container will contact the interior surface of the storage container at a second position along the interior of the storage container and adjacent the first position of a preceding loop. As thus far described, the apparatus and method of packing the welding wire into a storage container is similar to that of prior art welding wire packing arrangements. One novel aspect of the welding wire packing arrangement of the present invention relates to the process of changing the effective rotational speed at least once relative to the laying head. This changing the effective rotational speed can be accomplished in several ways such as, but not limited to, varying the rotation speed of storage container in a particular rotational direction at least once during the welding wire packing process, reversing the rotational direction of the storage container at least one once during the welding wire packing process, and/or varying the rotation speed of the laying head in a particular rotational direction at least once during the welding wire packing process. In the past, the storage container remained stationary or was rotated in a single direction while the storage container was being packed with the welding wire, thus the effective rotational speed of the container relative to the laying head remained contain throughout the packing of the storage container with welding wire. In the packing method of the present invention, the effective rotational speed of the container relative to the laying head is varied at least once during packing of the storage container. It has been found that by varying the effective rotational speed of the storage container relative to the laying head at least once during packing of the storage, there is a reduction in the amount of shifting of the welding wire in the storage container when the storage container is shipped to different locations.

In another and/or alternative aspect of the present invention, the rotational direction of the storage container is reversed at least once during the packing of welding wire in the storage container. In one embodiment of the invention, the number of reversals of rotational direction of the storage container during the packing of the storage container with the welding wire and/or the length of time the storage container is rotated in a particular direction during the packing of the welding wire into the storage container is selected to reduce the amount of shifting of the welding wire in the storage container. In one embodiment of the invention, the direction of rotation of the storage container is reversed at least once during the packing of the welding wire in the storage container. In one aspect of this embodiment, there is only a single reversal of rotation of the storage container during the packing of the welding wire in the storage container. In one non-limiting example, the reversal in direction takes place when about half of the storage container has been filled with the welding wire. As can be appreciated, the reversal can take place in other times, such as, but not limited to, when the storage container is filled with one-third of the welding wire, filled with two-thirds of the welding wire, filled with one-fourth of the welding wire, filled with three-fourths of the welding wire, etc. In another and/or alternative embodiment of the present invention, the direction of rotation of the storage container is reversed multiple times during the filling of the storage container with the welding wire. In one aspect of this embodiment, the number of direction reversals for the rotation of the storage container is related to the amount of welding wire which has been packed into the storage container. In one non-limiting example, if the direction of the storage container is to be reversed three times, the reversal of the storage container occurs when approximately one-fourth of the welding wire has been packed into a storage container, and the second reversal occurs when about one-half of the storage container has been packed, and the final reversal of the storage container rotation occurs when about three-fourths of the storage container has been filled with the welding wire. In another non-limiting example, if the storage container is to be reversed four times during the filling of the storage container, the first reversal occurs when about one-fifth of the welding wire has been packed into the storage container, the second reversal occurs when about two-fifths of the storage container has been filled with welding wire, and so forth. As can be appreciated in these two non-limiting examples, the time period the storage container changes directions is proportional to the number of desired reversal and the amount of welding wire packed in the storage container. In another and/or alternative aspect of this embodiment, at least one reversal of rotational direction of the storage container is not related to the proportion of welding wire which has been filled within the storage container. As such, one or more reversals of rotation direction can randomly occur during the packing of the welding wire in the welding wire storage container. Additionally or alternatively, one or more reversals of rotation can occur at fixed points during the packing of the welding wire, irrespective of the number of reversals of rotation that occur during the packing of the welding wire. In still another and/or alternative embodiment of the present invention, the speed of rotation of the storage container in any particular rotational direction can be constant, can be different, or can be varied.

In still another and/or alternative aspect of the present invention, the storage container rotates in one direction based on a number of rotational degrees and after which the storage container is reversed in rotational direction to rotate some number of rotational degrees. For example, the storage container can be set to rotate 18000° (i.e. 50 revolutions) in one direction and 9000° (i.e. 25 revolution in the opposite direction. The number of degrees of rotation the storage container rotates prior to changing rotational direction can be the same or different. In addition, number of degrees of rotation the storage container must rotate prior to changing rotational direction can be varied during the packing of the welding wire in the storage drum. In another and/or alternative embodiment of the present invention, the speed of rotation of the storage container in any particular rotational direction can be constant, can be different, or can be varied.

In yet another and/or alternative aspect of the present invention, the time period for which the storage container rotates in one direction and the time period in which the storage container is rotated in the opposite direction can be preprogrammed and/or be randomly determined. In one embodiment of the invention, the total amount of time that the storage container is rotated in one direction is substantially equal to the total amount of time the storage container is rotated in an opposite direction. As such, when the storage container is reversed in directions multiple times, the cumulative amount of time the storage container is rotated in one direction is substantially equal to the cumulative amount of time the storage container the storage container is rotated in an opposite direction. In another and/or alternative embodiment of invention, for at least one time that the storage container is reversed in direction, the time of rotation in one direction is greater than the time of rotation in another direction. In still another and/or alternative aspect of the present invention, the cumulative amount of time that the storage container is rotation in one direction is different from the cumulative amount of time that the storage container is rotated in an opposite direction. In another and/or alternative embodiment of the present invention, the speed of rotation of the storage container in any particular rotational direction can be constant, can be different, or can be varied.

In still yet another and/or alternative aspect of this invention, the time period for rotating the storage container in one direction corresponds to the number of rotations of the storage container in the particular direction of rotation and/or the amount of welding wire which has been packed into the storage container. In one embodiment of the present invention, the speed of rotation of the storage container in any particular rotational direction can be constant, can be different, or can be varied.

In still another and/or alternative aspect of this invention, the change of rotation direction of the storage container can be at least in part based on amount of welding wire feed into storage container, size or welding wire, type of welding wire, size of storage container, internal configuration of storage container, etc. In another and/or alternative embodiment of the present invention, the speed of rotation of the storage container in any particular rotational direction can be constant, can be different, or can be varied.

In still a further and/or alternative aspect of the present invention, the speed of rotation of the storage container and/or the welding wire feed rate can be constant or variable during the packing of the storage container with the welding wire. In one embodiment of this invention, the rotation speed of the storage container in the multiple rotational directions during the packing of the welding wire into the storage container is substantially constant throughout the packing of the storage container. In another and/or alternative embodiment of the present invention, the rotation speed of the storage container is varied in at least one rotational direction during the packing of the welding wire into the storage container. In still another and/or alternative embodiment of the present invention, the welding wire feed rate into the storage container is maintained substantially constant throughout the packing of the storage container with the welding wire. In still yet another and/or alternative embodiment of the present invention, the welding wire feed rate of the welding wire into the storage container is varied at least once during the packing of the welding wire into the storage container.

In yet a further and/or alternative aspect of the present invention, the rotatable laying head varies in speed of rotation at least once during the packing of welding wire in the storage container. The varying rotation speed of the laying head during the welding wire packing process can be done instead of the reversal of rotation of the storage container during the packing of the welding wire or can be done in addition to the reversal of rotation of the storage container and/or change in rotational speed of the storage container during the packing of the welding wire. Typically, the direction of rotation of the rotatable laying head does not change during the packing of the storage container with welding wire; however, it can be appreciated that the rotatable head could be designed to reverse in rotational direction if so desired. In one embodiment of the invention, the storage container is not rotated during the packing of the storage container with welding wire. In one aspect of this embodiment, the rotatable laying head varies in rotational speed once during the packing of welding wire in the storage container. In another and/or alternative aspect of this embodiment, the rotatable laying head varies in rotational speed a plurality of times during the packing of welding wire in the storage container. In another and/or alternative aspect of this embodiment, the rotatable laying head varies in rotational speed based on one or more predefined events (e.g., the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotation speed variations of the rotatable laying head during the packing process, the number of desired rotation speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc.). In still another and/or alternative aspect of this embodiment, the rotatable laying head randomly varies in rotational speed at least once during the packing of welding wire in the storage container. The random rotation speed can be based in any number of variables such as, but not limited to, the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotation speed variations of the rotatable laying head during the packing process, the number of desired rotation speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc. In another and/or alternative embodiment of the invention, the storage container, when rotated while packing the storage container with welding wire, rotates in a single direction throughout the packing process. In this embodiment, the packing of the welding wire in the storage container results solely from the change of rotational speed of the rotatable laying head during the welding wire packing process. In one aspect of this embodiment, the rotatable laying head varies in rotational speed once during the packing of welding wire in the storage container. In another and/or alternative aspect of this embodiment, the rotatable laying head varies in rotational speed a plurality of times during the packing of welding wire in the storage container. In another and/or alternative aspect of this embodiment, the rotatable laying head varies in rotational speed based on one or more predefined events (e.g., the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotational speed variations of the rotatable laying head during the packing process, the number of desired rotational speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc.). In still another and/or alternative aspect of this embodiment, the rotatable laying head randomly varies in rotation speed at least once during the packing of welding wire in the storage container. The random change in rotation speed can be based in any number of variables such as, but not limited to, the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotation speed variations of the rotatable laying head during the packing process, the number of desired rotation speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc. In still another and/or alternative embodiment of the invention, the storage container reverses rotational direction at least once while packing the storage container with welding wire. In one aspect of this embodiment, the rotatable laying head varies in rotational speed once during the packing of welding wire in the storage container and/or the storage container reverses rotational direction once during the packing of welding wire in the storage container. In another and/or alternative aspect of this embodiment, the rotatable laying head varies in rotational speed a plurality of times during the packing of welding wire in the storage container and/or the storage container reverses rotational direction a plurality of times during the packing of welding wire in the storage container. In still another and/or alternative aspect of this embodiment, the rotatable laying head varies in rotation speed and/or the storage container reverses rotational direction based on one or more predefined events (e.g., the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotational speed variations of the rotatable laying head during the packing process, the number of desired rotational speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc.). In yet another and/or alternative aspect of this embodiment, the rotatable laying head randomly varies in rotational speed at least once during the packing of welding wire in the storage container and/or the storage container randomly reverses rotational direction at least once during the packing of welding wire in the storage container. The random speed change and/or random reversal of rotation can be based in any number of variables such as, but not limited to, the number of rotations of the rotatable laying head, the number of rotations of the storage container, the time period of rotation of rotatable laying head at a certain speed, the time period of rotation of the storage container at a certain speed, the time period of rotation of the storage container in a certain direction, the percentage of the storage container filled with welding wire, the number of desired rotational speed variations of the rotatable laying head during the packing process, the number of desired rotational speed variations of the storage container during the packing process, the number of desired reversals of rotation of the storage container during the packing process, the number of desired rotational speed changes of the storage container during the packing process, the number of degrees of rotation of the rotatable laying head, the number of degrees of rotation of the storage container, the amount of welding wire fed into storage container, etc. In still yet another and/or alternative aspect of this embodiment, time period of rotation of the rotatable laying head in at a specific rotational speed is the same as the time period of rotation of the storage container in the same direction. In one non-limiting example, the cumulative time of rotation of the rotatable laying head at a specific rotational speed is the same as the cumulative time of rotation of the storage container in a particular direction. In a further and/or alternative aspect of this embodiment, time of rotation of the rotatable laying head at a particular rotational speed is different from the time of rotation of the storage container in a particular. In one non-limiting example, the cumulative time of rotation of the rotatable laying head in at a specific rotational speed is different from the cumulative time of rotation of the storage container in a particular direction. In still a further and/or alternative aspect of this embodiment, time period of rotation of the rotatable laying head in at a specific rotational speed is the same as the time of rotation of the storage container in a direction opposite the rotational direction of the rotatable laying head. In one non-limiting example, the cumulative time of rotation of the rotatable laying head in at a specific rotational speed is the same as the cumulative time of rotation of the storage container in a direction opposite the rotational direction of the rotatable laying head. In yet a further and/or alternative aspect of this embodiment, time of rotation of the rotatable laying head in at a specific rotational speed is different from the time of rotation of the storage container in a direction opposite the rotational direction of the rotatable laying head. In one non-limiting example, the cumulative time of rotation of the rotatable laying head in a specific direction is different from the cumulative time of rotation of the storage container in the opposite direction. In yet another and/or alternative embodiment of the invention, the rotational direction and/or speed of the rotatable laying head alone or in conjunction with the rotational direction and/or speed of the storage container at any time during the packing of the welding wire in the storage container is such that the welding wire is continuously packed in the same direction in the storage container. For instance, the welding wire is initially laid in the storage container in a clockwise direction. This direction of packing the welding wire in the storage container will not change throughout the packing process irrespective of the change of speed and/or direction of rotation of the storage container and/or the rotatable laying head during the packing process. In one aspect of this embodiment, the rotatable laying head rotates in a single direction and the speed of rotation is greater than the speed of rotation of the storage container in a rotational direction opposite the rotational direction of the rotatable laying head. In one non-limiting example, the rotatable laying head rotates in a single direction and the speed of rotation is greater than the speed of rotation of the storage container in any rotational direction. In another and/or alternative aspect of this embodiment, the storage container rotates in a single direction and the speed of rotation is greater than the speed of rotation of the rotatable laying head in a rotational direction opposite the rotational direction of the storage container. In one non-limiting example, the storage container rotates in a single direction and the speed of rotation is greater than the speed of rotation of the rotatable laying head in any rotational direction.

A principal object of the present invention is the provision of a welding wire storage container that is at least partially packed with welding wire in a manner that reduces the amount of shifting of the welding wire in the storage container during the transport of the storage container.

Another and/or alternative object of the present invention is the provision of a welding wire storage container that is at least partially packed with welding wire and which exhibits reduced the number of tangles (e.g., bird nesting, etc.) of the welding wire as the welding wire is paid out from the storage container.

Still another and/or alternative object of the present invention is the provision of a welding wire storage container that has a unique packing arrangement of the welding wire within the storage container which is at least partially obtained by varying the effective rotational speed of the storage container relative to the laying head at least once during packing of the welding wire in the storage container.

Still another and/or alternative object of the present invention is the provision of a welding wire storage container that has a unique packing arrangement of the welding wire within the storage container resulting from the varying the effective rotational speed of the storage container relative to the laying head at least once during packing of the welding wire into the storage container.

Yet another and/or alternative object of the present invention is the provision of an apparatus and method for at least partially packing welding wire in a storage container to obtain a unique packing arrangement of the welding wire in a storage container which is at least partially obtained by varying the effective rotational speed of the storage container relative to the laying head at least once during the packing of the welding wire in the storage container.

A further and/or alternative object of the present invention is the provision of an apparatus and method for at least partially packing welding wire in a storage container so as to break the continuous slope of fanned out wire loops in the container thereby preventing or inhibiting the loops to corkscrew downwardly in the container, thus producing a more stable stack.

These and other objects of the present invention will become apparent to those skilled in the art upon the reading and understanding of the detailed description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE INVENTION

Figure 1:
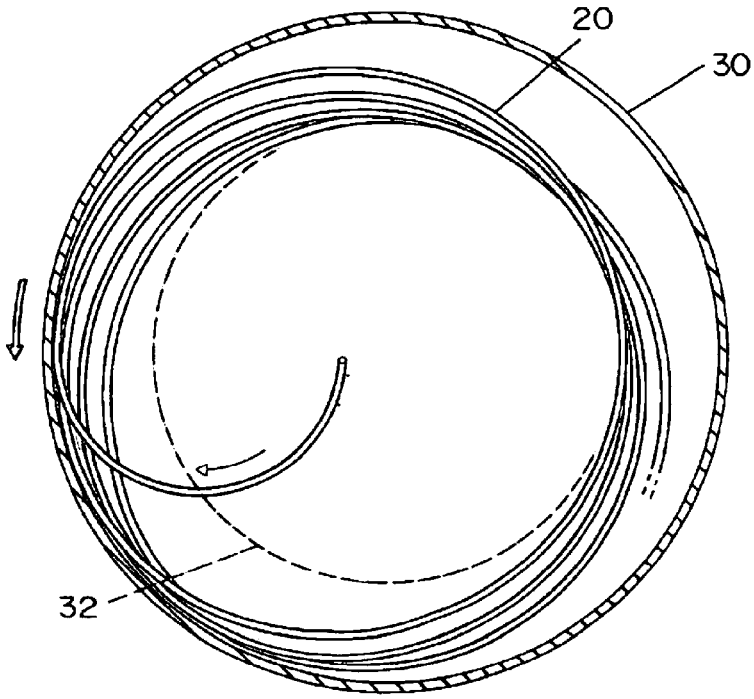
FIG. 1 (PRIOR ART)
FIG. 1 is a plan view showing the method of placement of welding wire as taught in the prior art.
Figure 2:
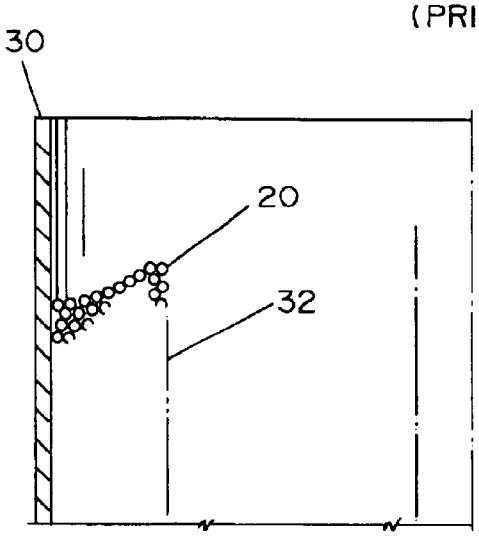
FIG. 2 (PRIOR ART)
FIG. 2 is a partial elevational view in cross-section, showing the density variation of packing welding wire in the prior art.
Figure 3:
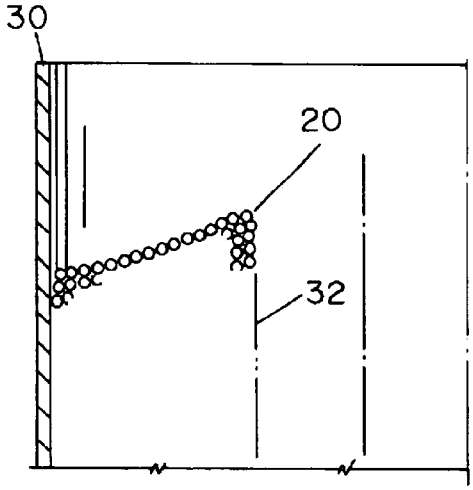
FIG. 3 (PRIOR ART)
FIG. 3 is a partial elevational view, in cross-section, showing the density variation of packed welding wire in the prior art.

Referring now to the drawings, wherein the showings are for the purpose of illustrating preferred embodiments of the invention only and not for the purpose of limiting the same, the present invention is directed to a novel method of packing welding wire in a storage container so as to minimize the shifting of the welding wire after packing and to also minimize the tangling (e.g., bird nesting, etc.) of the welding wire as the welding wire is dispensed from a welding wire storage container. FIGS. 1–3 illustrate prior art arrangements for packing welding wire into a storage container. The welding wire 20, such as welding wire, is fed into a storage container 30 and forms a central cavity 32 as the welding wire in packed in the storage container. As can be seen from FIGS. 2 and 3, the method of packing the welding wire in the storage container results in a loose density packing of the welding wire within the storage container wherein the welding wire has a higher density along the edge portion of the storage container and the inside diameter of the stack itself adjacent the central or wire stack or coils cavity than the density in the middle of the stack or coils. This is packing arrangement is caused by more welding wire being placed along the edge portions of the storage container than being placed along the central or wire stack or coils cavity. The higher density of welding wire along the edge portion of the storage container is susceptible to welding wire settling in the storage container. The settling of the welding wire can result in the tangling (e.g., bird nesting, etc.) of the welding wire as the welding wire is paid out of the storage container. The present invention overcomes many of this these past problems with the settling of the welding wire after the welding wire has been packed into a storage container. The prior art of wire loop packing has one loop slightly offset from the previous loop, thus creating a continuous "slope". This slope spirals down from the top of the drum all the way to the bottom of the drum. This winding arrangement of the present invention intends to break this continuous slope by changing the fan-out direction of the loops, thus creating a mechanical interlock to inhibit or prevent a continuous sliding of wire loops during vibration.

Figure 4:
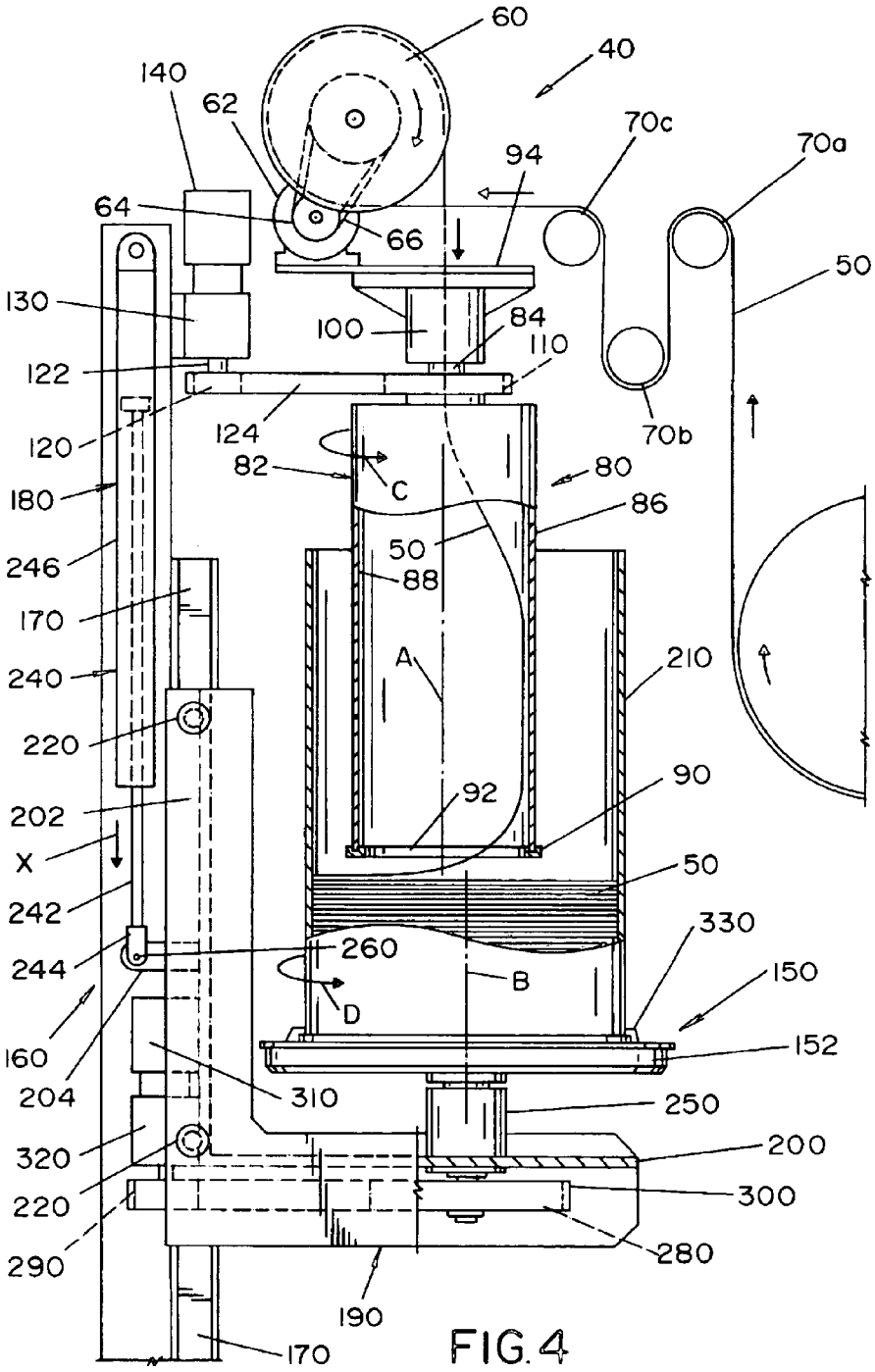
FIG. 4 is an elevation view illustrating the packaging system according to the present invention.

Referring now to FIG. 4, a storage container winding system 40 is illustrated. The storage container winding system draws a continuous welding wire 50 from a manufacturing process (not shown). As can be appreciated, welding wire 50 can be package from a reel of welding wire (not shown) instead of being packaged directly after being formed from a manufacturing process. Welding wire 50 is typically welding wire and will be hereafter referred to as welding wire; however, welding wire other than welding wire can be packed in a storage container in accordance the method and process of the present invention. Welding wire 50 is drawn by a capstan 60 driven by a welding wire feed motor 62 connected to a pulley 64 which drives a belt 66. As can be appreciated, the capstan can be driven by other means. As can be seen, the welding wire is pulled over a series of rolls and dancer rolls 70*a*, 70*b* and 70*c* which serve to straighten the welding wire 50 and to set a proper cast to the wire according to specification between the feeder reel or supply reel and capstan 60. As can be appreciated, the welding wire can be straightened and/or set in a proper cast by other or additional means. As can be seen from FIG. 4, welding wire 50 is wrapped about 270° about capstan 60. This particular configuration provides the desired friction and inhibits or prevent wire twist produced by the rotating laying head from being released upstream as welding wire 50 is drawn across the dancer rolls 70*a*–70*c*. Welding wire 50 is fed into a rotatable laying head 80 which is suspended from a winding beam 94. Rotatable laying head 80 rotates within a bearing housing 100 which is suspended from winding beam 94. Rotatable laying head 80 includes a laying tube 82 and a journal portion 84 extending therefrom and supported for rotation by a flange and a top and a bottom bearing located at the top and bottom ends, respectively, of bearing housing 100. It will be appreciated that journal portion 84 includes both an outer cylindrical surface for contact with bearings in the interior of bearing housing 100 and an inner cylindrical surface defining a hollow shaft interior which allows welding wire 50 to pass from capstan 60 to laying tube 82.

A pulley 110 is keyed into the outer cylindrical surface of journal portion 84 below bearing housing 100. A corresponding pulley 120 extends from a shaft 122 of a layer drive motor 130. A belt 124 connects pulleys 110 and 120 in order that layer drive motor 130 drives journal portion 84 and correspondingly drives rotatable laying head 80.

The control panel 140 directs the speed of laying head drive motor 130 and capstan drive motor 62 as well as coordinating the ratio between the speed of the two motors. The motor speed affects the rotational velocity of laying head 80 and the rotational velocity of capstan 60. It will be appreciated that the ratio between the laying head rotational velocity and the capstan rotational velocity determines a loop size diameter of welding wire 50 as the welding wire in packed into a storage container as will be described below.

Laying head 82 includes an outer cylindrical surface 86, an inner cylindrical surface 88, and a generally closed upper end. A small hole centered about a centerline axis A of laying head 82 extends between inner surface 88 and outer surface 86. The lower end of journal portion 84 extends through the small hole. The bottom end of laying tube 82 can include a ring 90 extending about the circumference of the lower end of laying tube 80; however, this is not required. Ring 90 has an opening 92 through which welding wire 50 passes from laying tube 80 during the packing operation. The liner tube can be provided inside the laying head for the wire passage from top of the laying head to the bottom exit. The liner can be designed to have a downward spiral that builds in a twist into every loop of wire the laying head lays.

A turntable 150 is supported for rotation on a turntable support 160. Turntable support 160 includes guide tracks 170, a force cylinder 180, and an L-shaped beam portion 190. Turntable support 160 allows rotation of turntable 150 thereupon, and specifically upon a horizontal beam 200 of L-shaped beam portion 190. It will be appreciated that as the weight of welding wire 50 is placed within storage container 210, a vertical beam portion 202, which is attached to the guide wheels 220, rides downward on guide tracks 170, which is shown as an H-beam. Thus, L-shaped beam portion 190 rides downward on guide tracks 170 while storage container 210 is filled.

In one non-limiting design, vertical beam portion 202 includes a finger 204 which extends outwardly therefrom and is pivotally attached at pin 260 to an outward end 244 of a rod 242, which is part of a pressurized cylinder assembly 240. Pressurized cylinder assembly 240 includes a pressurized cylinder 246. It will be appreciated that pressurized cylinder 246 is pressurized such that when storage container 210 is empty, pressurized cylinder 246 is at equilibrium and L-shaped beam portion 19 is at its highest point on guide tracks 170. As can be appreciated, other arrangements can be used. As storage container 210 is filled with welding wire 50, the additional weight placed on turntable 150 causes piston rod 242 to extend downward as shown by arrow X in a controlled descent down guide tracks 170. The pressure within pressurized cylinder 246 is based upon a predetermined weight to pressure ratio. As can be appreciated, a controlled decent of the turntable can be accomplished by other means (e.g. indexing motor and gear arrangement, etc.). The controlled descent allows welding wire 50 to be placed within storage container 210 from the bottom of storage container 210 adjacent turntable 150 to the top lip of storage container 210. As such, rotatable laying head 80 does not move in a vertical direction but instead turntable 150 moves in the vertical direction on centerline axis B which is parallel to the centerline axis A of laying tube 80. As can be appreciated, the position of storage container 210 can be moved relative to rotatable laying head by a number of other means such as, but not limited to, the rotatable laying head moving upwardly as the storage container is filled, the rotatable laying head moving upwardly and the storage container moving downwardly as the storage container is filled, etc.

Turntable 150 is rotatably driven in a manner similar to laying tube 82. A bearing housing 250 is mounted on horizontal beam 200 of L-shaped beam portion 190. A journal portion 252 extends downwardly from turntable 150 and is allowed to freely rotate by means of the bearings 270 and 272. In accordance with one non-limiting arrangement, journal portion 252 is a cylinder which has an outer cylindrical surface 262 and an inner cylindrical surface for purposes which will be described later. A cogbelt pulley 280 is keyed to the bottom end of journal portion 252. Cogbelt pulley 280 is connected to a second cogbelt pulley 290 by a belt 300. Cogbelt pulley 290 is driven by a turntable motor 310 through a gearbox 320. Turntable motor 310 is geared down substantially from laying tube 82 in order than turntable 150 only rotates a fraction of a single revolution relative to a full revolution of laying tube 82. As can be appreciated, other designs can be used to rotate and/or control the speed of the turntable.

Figure 4A:
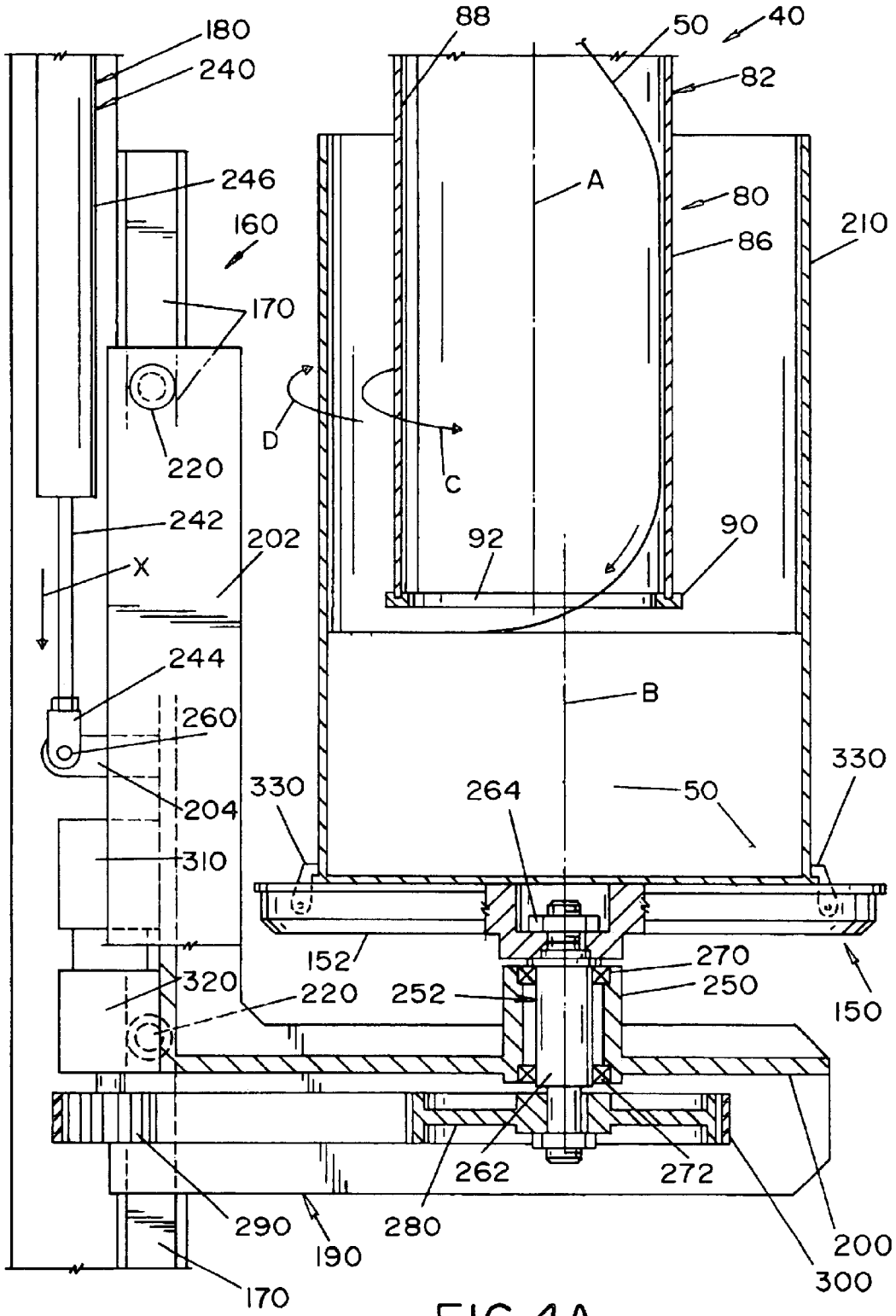
FIG. 4A is an enlarged fragmentary elevation view showing the bottom half of FIG. 4.

As can be best seen from FIGS. 4 and 4A, turntable 150 includes a bottom platform 152 which is driven for rotation by a top end key assembly 264 of journal portion 260. The invention thus allows a storage container 210 mounted on turntable 150 and specifically mounted with clips 330 to be filled in accordance with the method as shown in FIGS. 5–9. As can be seen, welding wire 50 is placed within storage container 210 by rotation of laying tube 82 about axis A. The rotation of laying tube 82 is shown by arrow C in FIGS. 4 and 4A. It will be appreciated that laying tube axis A is offset from the centerline axis B of storage container 210. Many of the components of the storage container winding system described above are similar to the storage container winding system disclosed in U.S. Pat. No. 6,019,303, which is incorporated herein by reference.

The packing pattern for the welding wire differs from prior packing methods in that the effective rotational speed of the storage container relative to the laying head varies during packing of the welding wire into the storage container. This can be accomplished in several ways. One way is to substantially keep constant the rotational speed and rotational direction of rotatable laying head 80 and to vary the rotational speed and/or rotational direction of storage container 210 on turntable 150. Another way is to substantially keep constant the rotational speed and rotational direction of storage container 210 on turntable 150 and to vary the rotational speed and/or rotational direction of rotatable laying head 80. Still another way is some combination of the two ways set forth above. The first way of packing the wire will be described in detail below; however, this operation can in part be equally applied to the other ways for packing the welding wire in the storage container in accordance with the present invention.

Figure 5A:
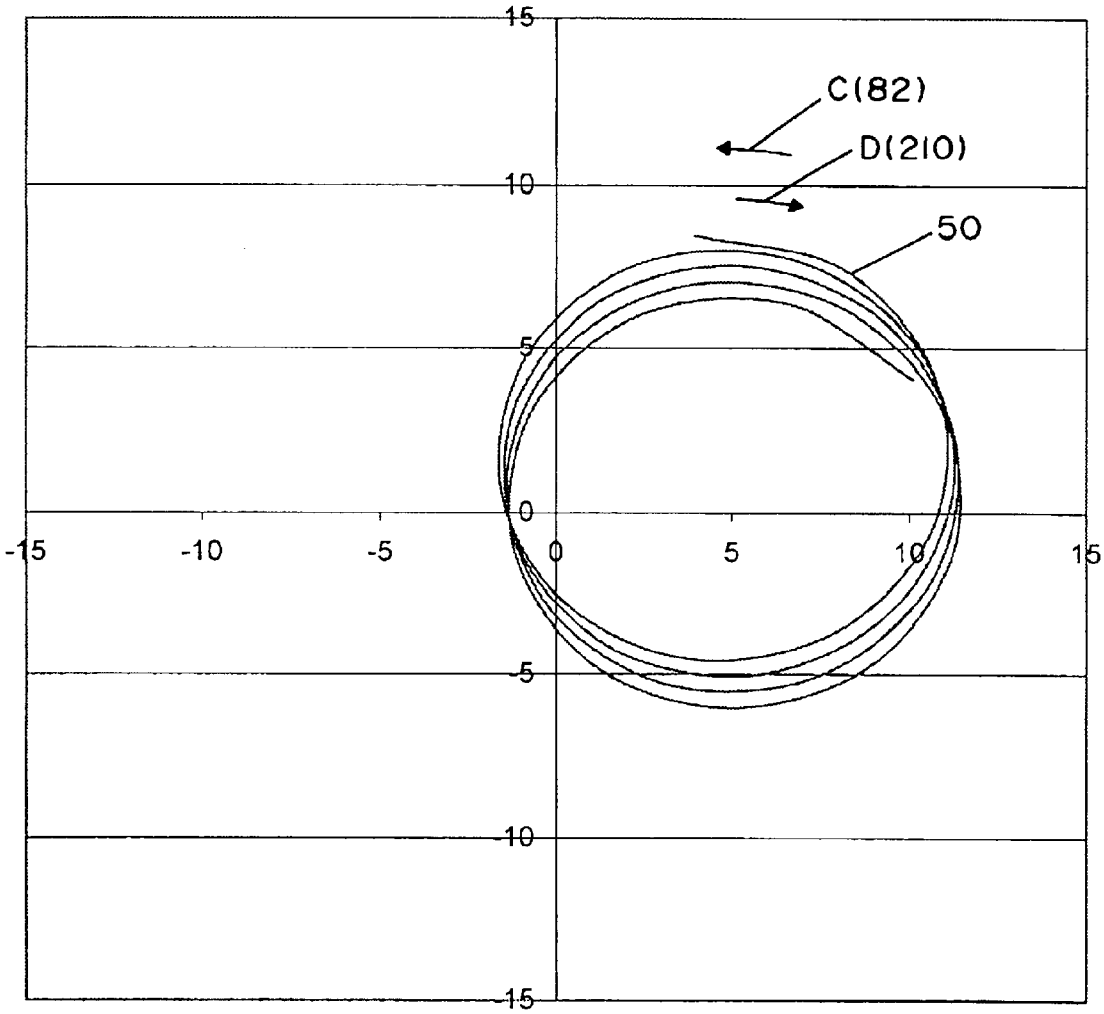
FIGS. 5A and 5B show the steps in layering the welding wire in accordance with the present invention.
Figure 5B:
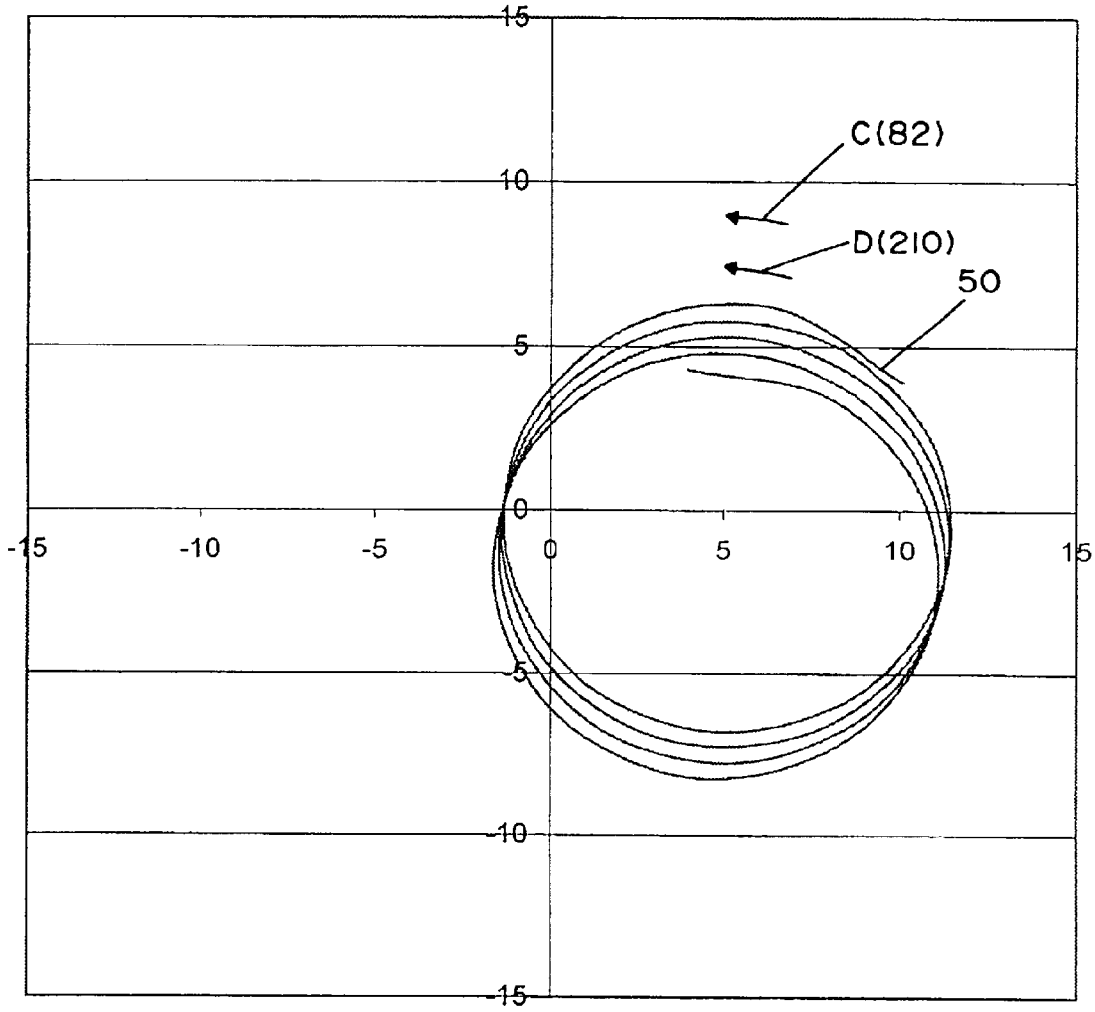

The speed and rotational direction of rotatable laying head 80 is controlled to be substantially constant during the packing of the welding wire in the storage container. During the packing process, the rotational direction of the storage container is reversed at least once. The change of rotational direction of the storage container is illustrated in FIGS. 5A and 5B. As illustrated in FIG. 5A, the turntable rotates the storage container in a clockwise direction as indicated by the arrow D. The rotation of the laying tube is also in the counterclockwise direction as illustrated by arrow C in FIG. 4. As can be appreciated, the rotational direction of the laying tube can be in clockwise direction. As set forth above, FIG. 5A illustrates welding wire 50 being fed from rotating laying tube 82 which is rotating in a counterclockwise direction into the storage container 210 which is rotating in a clockwise direction as indicated by arrow D. Welding wire 50 has little, if any, memory thus lays flat in the storage container. The position of the welding wire in the storage container is principally dictated by the rotational direction of the laying tube, the storage container and the flexibility of the welding wire. Referring now to FIG. 5B, an alternative method of packaging the welding wire is illustrated. As shown in FIG. 5B, the turntable rotates the storage container in the counterclockwise direction as represented by arrow D and the laying tube also rotates in a counterclockwise direction as represented by arrow C. As can be appreciated, other combinations of the direction of rotation of the laying head in combination with the rotation direction of the turntable can be used to achieve the novel packing arrangement of the welding wire in a container. One non-limiting example of the parameters used to pack the welding wire in the storage container, a welding wire having a wire diameter of about 0.04–0.06 inch is fed into a storage container at a rate of about 1500–3000 fpm as the laying tube rotates in a clockwise direction at about 200–800 rpm and the storage container periodically changes rotational direction to rotate in either the clockwise or counterclockwise direction at about 0.01–20 rpm, and more typically about 0.1–10 rpm. As can be appreciated, other parameters can be used.

Figure 6A:
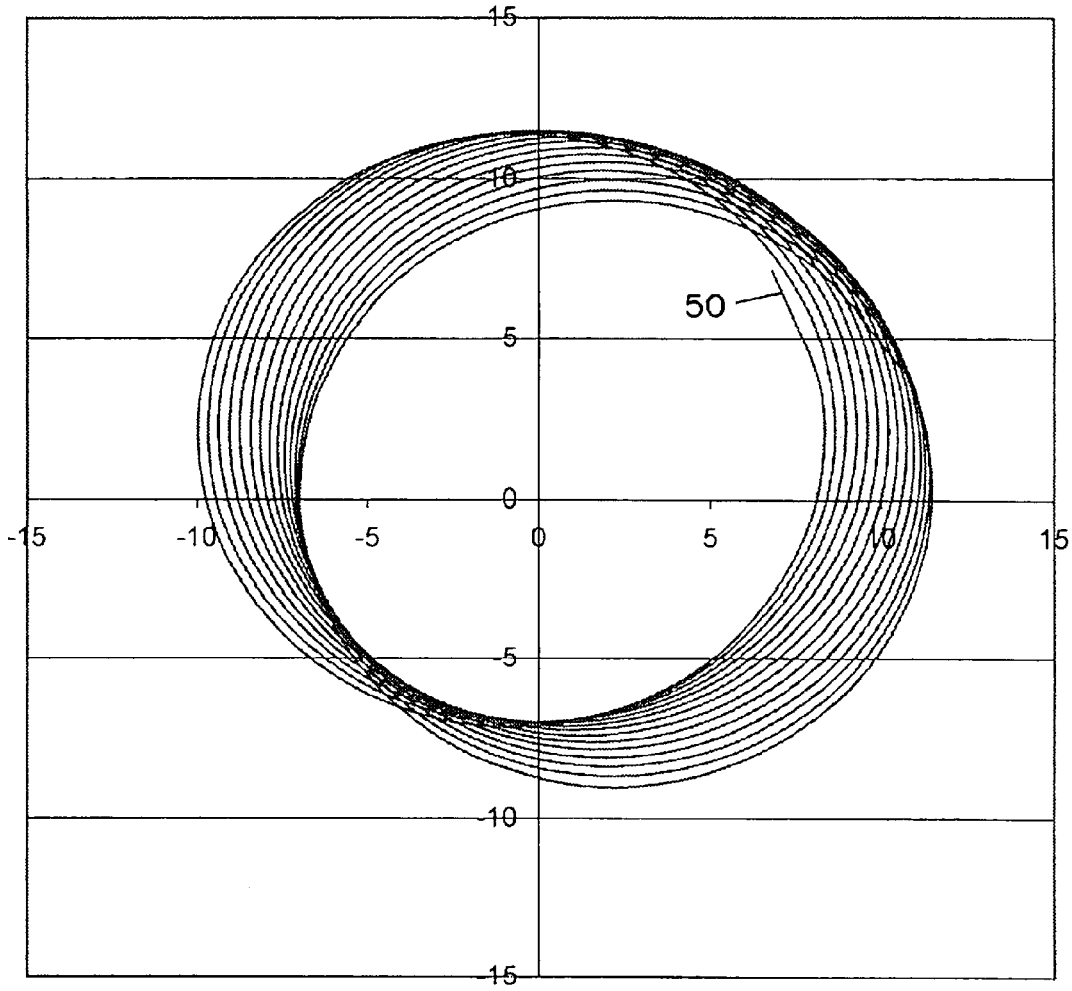
FIGS. 6A and 6B illustrates various patterns of the packed welding wire in accordance with the present invention.
Figure 6B:
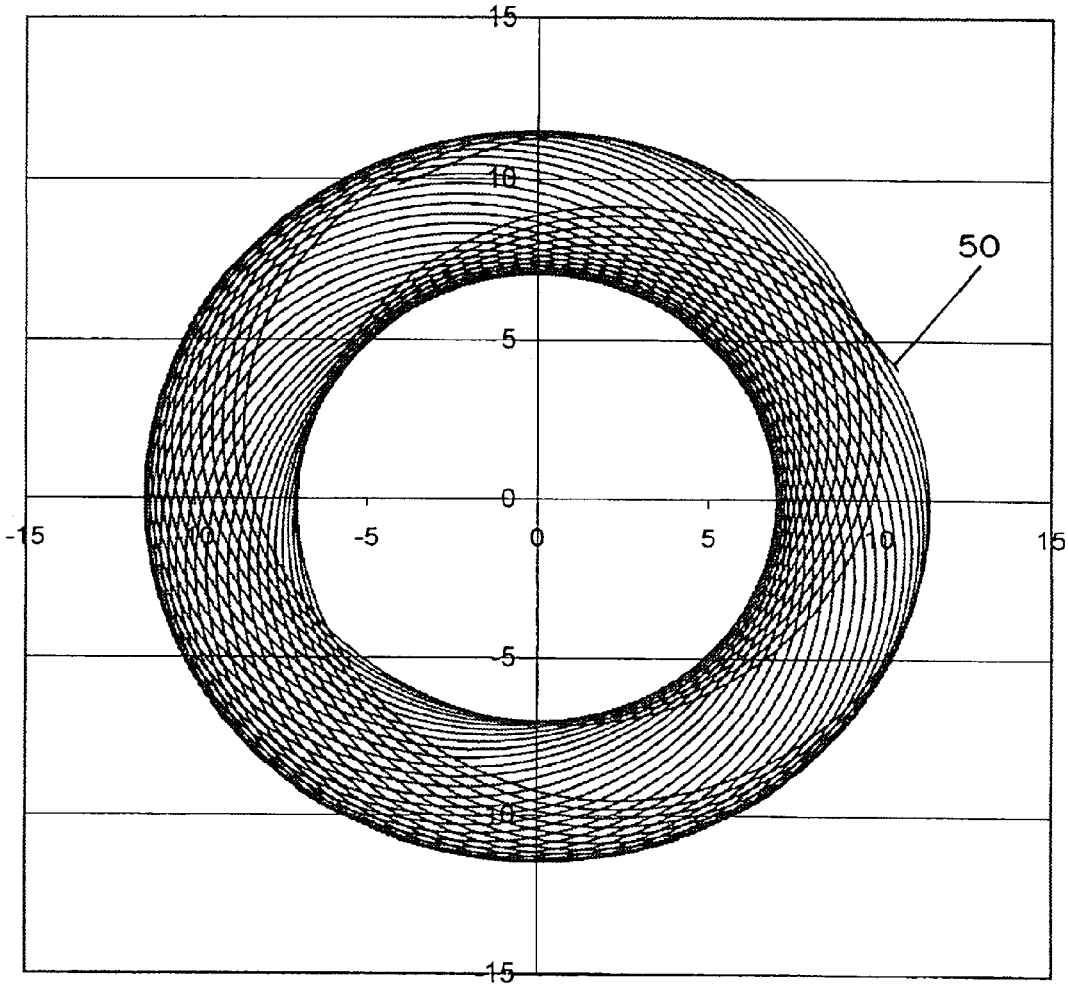

A comparison of the wire laying patterns illustrated in FIGS. 5A and 5B reveals that the welding wire is laid differently in the storage container due to the change of rotational direction of the storage container. FIGS. 6A and 6B illustrate the formation of a unique wire laying pattern in the storage container during the packing process.

Figure 7:
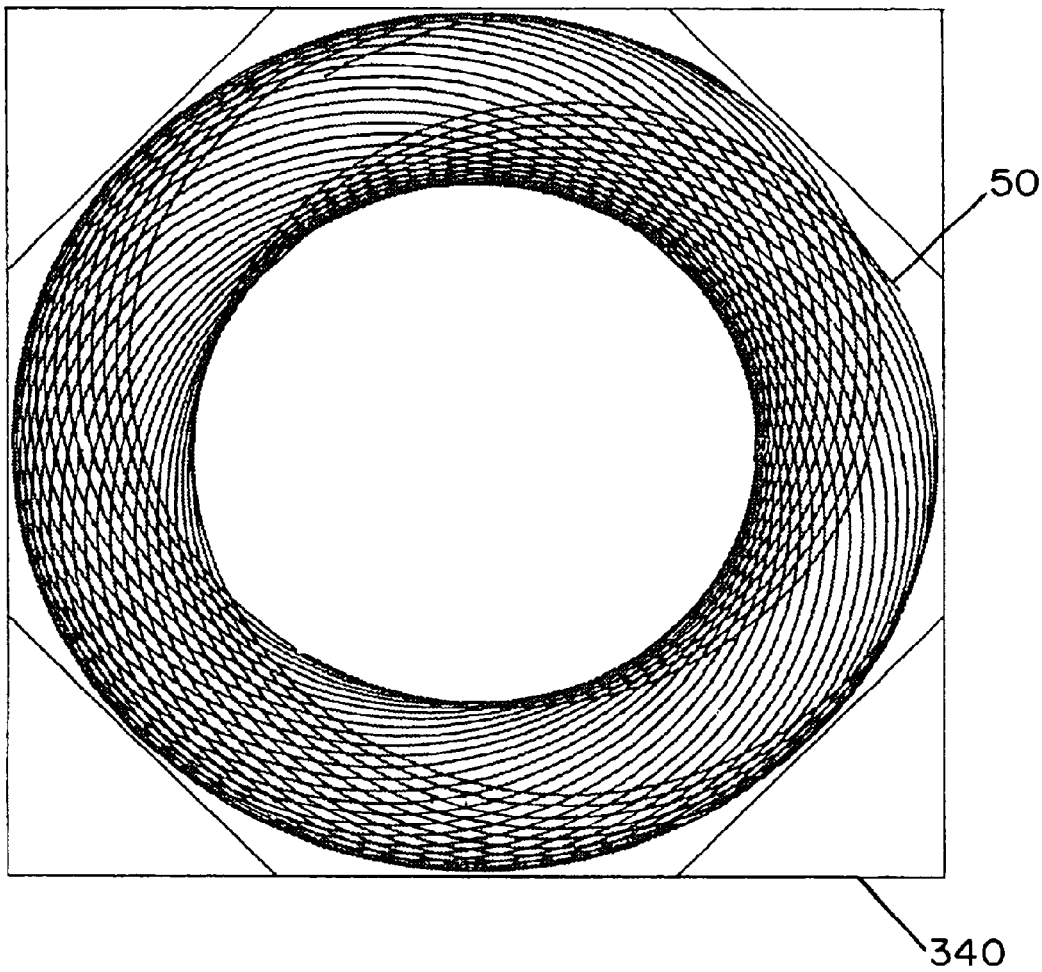
FIG. 7 illustrates a pattern of packed welding wire in a non-circular storage container in accordance with the present invention; and, FIGS. 8 and 9 illustrate the direction of rotation of the welding wire storage container during the packing of the welding wire contain in accordance with the present invention.

Referring now to FIG. 7, there is illustrated welding wire that is packed in accordance with the present invention in a storage container having a non-circular cross-sectional shape. As can be appreciated, the storage container 340 can have a circular cross-sectional shape similar to that illustrated in FIG. 1.

Figure 8:
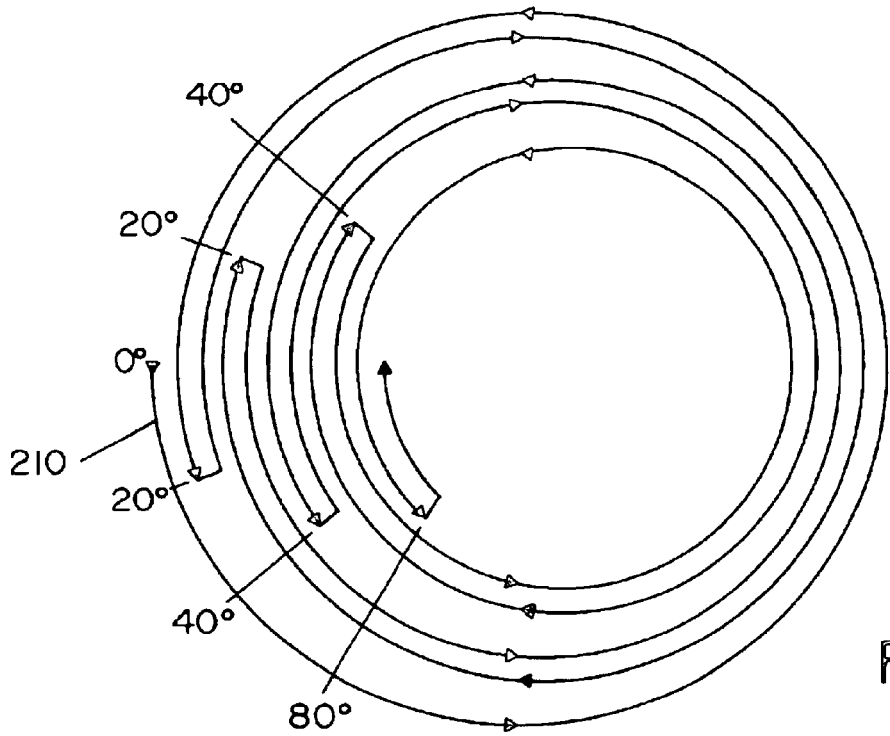
Figure 9:
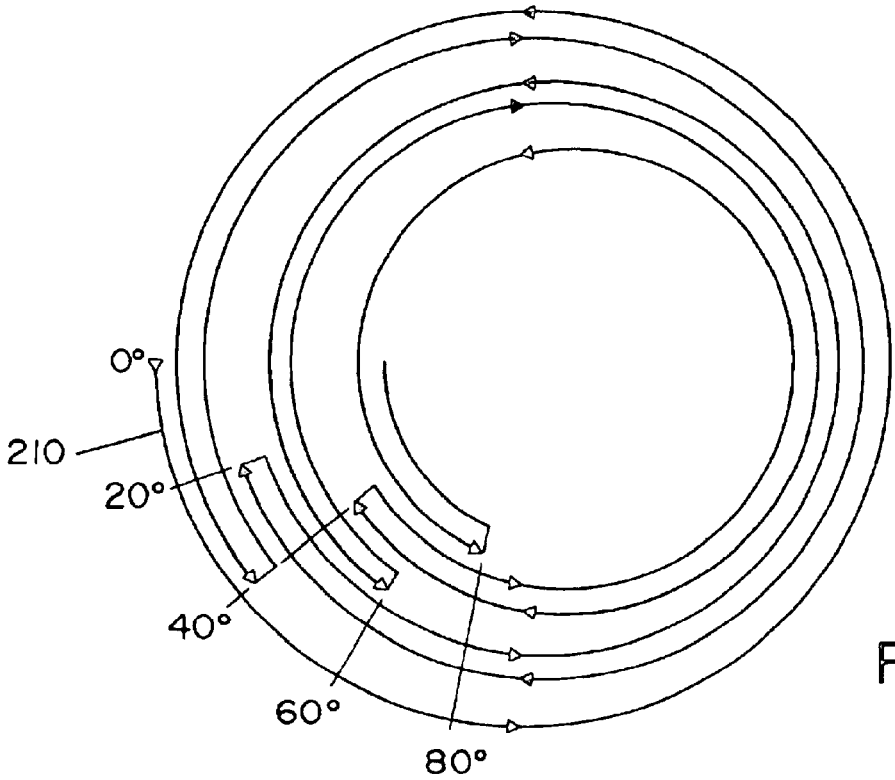

FIGS. 8 and 9 illustrate two different methods of controlling when the reversal of direction of rotation of the storage container is to occur. As illustrated in FIG. 8, the storage container 210 initially begins to rotate in the counterclockwise direction. The laying tube 82 continuously rotates in the counterclockwise direction, typically at a substantially constant speed. The laying tube rotational speed is greater than the rotational speed of the storage container in either the clockwise or counterclockwise direction. The counterclockwise direction of the storage drum is maintained until it is rotated about 40° past the point the wire packing process began. At such point, the direction of rotation of the storage container is reversed such that the storage container begins rotating in the clockwise direction until it is rotated about 20° past the point of the previous reversal of rotation. This pattern is repeat until the storage container is filled with welding wire. The direction of rotation of the storage container can represent a single rotation of a plurality of rotations. For example, the first rotational direction in the counterclockwise direction can indication the rotation of the storage container of about 380°, 740°, 1100°, etc. Likewise, the second rotational direction in the clockwise direction can indication the rotation of the storage container or about 400°, 760°, 1120°, etc. Likewise, the third rotational direction in the counterclockwise direction can indication the rotation of the storage container of about 440°, 800°, 1160°, etc. This pattern continues until the storage container is filled. The periodic change of the fan-out direction of the wire loops creates a mechanical interlock to inhibit or prevent a continuous sliding of the wire loops in packed drum when the drum is subject to vibration.

FIG. 9 illustrates another method of controlling when the reversal of direction of rotation of the storage container is to occur. As illustrated in FIG. 9, the storage container 210 initially begins to rotate in the counterclockwise direction. The laying tube continuously rotates in the counterclockwise direction, typically at a substantially constant speed. The laying tube rotational speed is greater than the rotational speed of the storage container in either the clockwise or counterclockwise direction. The counterclockwise direction of the storage drum is maintained until it is rotated about 40° past the point the wire packing process began. At such point, the direction of rotation of the storage container is reversed such that the storage container begins rotating in the clockwise direction until it is rotated about 20° past the point of the previous reversal of rotation. This pattern is repeat until the storage container is filled with welding wire. The direction of rotation of the storage container can represent a single rotation of a plurality of rotations. For example, the first rotational direction in the counterclockwise direction can indication the rotation of the storage container of about 400°, 760°, 1120°, etc. Likewise, the second rotational direction in the clockwise direction can indication the rotation of the storage container or about 380°, 740°, 1100°, etc. Likewise, the third rotational direction in the counterclockwise direction can indication the rotation of the storage container of about 400°, 760°, 1120°, etc. This pattern continues until the storage container is filled. As can be appreciated, many other pattern can be used in accordance with the present invention.

The invention has been described with reference to preferred and alternate embodiments. Modifications and alterations will become apparent to those skilled in the art upon reading and understanding the detailed discussion of the invention provided herein. The invention is intended to include all such modifications and alterations insofar as they come within the scope of the present invention.

What is claimed is:

1. An apparatus to pack welding wire in a storage container comprising:

a laying head of a winding machine that packs wire loop in the storage container; and, a turntable having a storage container support to support the storage container and a rotating mechanism to rotate the storage container support while the welding wire is packed into said storage container in fanning out wire loops, said rotating mechanism rotating said storage container support in a forward direction and in a reverse direction for a period of time while said welding wire is packed into said storage container.

2. The apparatus as defined in claim 1, including a capstan to pull said welding wire and a rotatable laying head to receive said welding wire from the capstan and to direct the welding wire into the storage container.

3. The apparatus as defined in claim 2, wherein said rotating mechanism includes a drive motor that turns said storage container support, said rotating mechanism rotating said storage container support in the forward direction for a first time period and in the reverse direction for a second time period.

4. The apparatus as defined in claim 3, wherein said first and second time periods are substantially the same.

5. The apparatus as defined in claim 4, wherein said rotating mechanism at least rotates said storage container support in at least in said forward direction, and then in said reverse direction, then again in said forward direction while said welding wire is packed into said storage container.

6. The apparatus as defined in claim 5, wherein said rotating mechanism rotates said storage container support at a substantially constant speed in said forward and said reverse direction.

7. The apparatus as defined in claim 6, wherein said rotating mechanism rotates said storage container support in a repeating sequence of 0.1–1.00 rotations in said forward direction followed by 0.1–100 rotations in said reverse direction.

8. The apparatus as defined in claim 5, wherein said rotating mechanism rotates at a speed in said forward direction that is different from a speed in said reverse direction.

9. The apparatus as defined in claim 8, wherein said rotating mechanism rotates said storage container support in a repeating sequence of 0.1–100 rotations in said forward direction followed by 0.1–100 rotations in said reverse direction.

10. The apparatus as defined in claim 3, wherein said first time period is different from said second time period.

11. The apparatus as defined in claim 10, wherein said rotating mechanism at least rotates said storage container support in at least in said forward direction, and then in said reverse direction, then again in said forward direction while said welding wire is packed into said storage container.

12. The apparatus as defined in claim 11, wherein said rotating mechanism rotates said storage container support at a substantially constant speed in said forward and said reverse direction.

13. The apparatus as defined in claim 12, wherein said rotating mechanism rotates said storage container support in a repeating sequence of 0.1–100 rotations in said forward direction followed by 0.1–100 rotations in said reverse direction.

14. The apparatus as defined in claim 11, wherein said rotating mechanism rotates at a speed in said forward direction that is different from a speed in said reverse direction.

15. The apparatus as defined in claim 14, wherein said rotating mechanism rotates said storage container support in a repeating sequence of 0.1–100 rotations in said forward direction followed by 0.1–100 rotations in said reverse direction.

16. The apparatus as defined in claim 2, including a laying head controller to rotate said laying head in a forward direction for a period of time and a reverse direction for a period of time while said welding wire is packed into said storage container.

17. The apparatus as defined in claim 1, wherein said rotating mechanism includes a drive motor that turns said storage container support, said rotating mechanism rotating said storage container support in the forward direction for a first time period and in the reverse direction for a second time period.

18. The apparatus as defined in claim 17, wherein said first and second time periods are substantially the same.

19. The apparatus as defined in claim 18, wherein said rotating mechanism at least rotates said storage container support in at least in said forward direction, and then in said reverse direction, then again in said forward direction while said welding wire is packed into said storage container.

20. The apparatus as defined in claim 17, wherein said first time period is different from said second time period.

21. The apparatus as defined in claim 20, wherein said rotating mechanism at least rotates said storage container support in at least in said forward direction, and then in said reverse direction, then again in said forward direction while said welding wire is packed into said storage container.

22. The apparatus as defined in claim 17, wherein said rotating mechanism at least rotates said storage container support in at least in said forward direction, and then in said reverse direction, then again in said forward direction while said welding wire is packed into said storage container.

23. The apparatus as defined in claim 17, wherein said rotating mechanism rotates said storage container support at a substantially constant speed in said forward and said reverse direction.

24. The apparatus as defined in claim 17, wherein said rotating mechanism rotates at a speed in said forward direction that is different from a speed in said reverse direction.

25. The apparatus as defined in claim 17, wherein said rotating mechanism rotates said storage container support at a variable speed in said forward direction.

26. The apparatus as defined in claim 17, wherein said rotating mechanism rotates said storage container support in a repeating sequence of 0.1–100 rotations in said forward direction followed by 0.1–100 rotations in said reverse direction.

27. The apparatus as defined in claim 26, wherein a number of rotations in said forward direction is substantially the same as a number of rotations in said reverse direction.

28. The apparatus as defined in claim 1, wherein said rotating mechanism rotates said storage container support at a variable speed in said reverse direction.

29. The apparatus as defined in claim 1, wherein said laying head feeds said welding wire at a substantially constant rate into said storage container.

30. The apparatus as defined in claim 1, wherein said laying head feeds said welding wire at a variable rate into said storage container.

31. A method of packing welding wire into a storage container comprising:

providing a welding wire packer having a laying head that packs wire loop in the storage container;

providing a storage container support to support said storage container as said welding wire is packed into said storage container in fanning out wire loops; and, varying an effective rotational speed of said storage container relative to said laying head at least once while said welding wire is packed into said storage container, wherein said step of varying an effective rotational speed includes turning said storage container support in a forward direction for a first time period and turning said storage container support in a reverse direction for a second time period.

32. The method as defined in claim 31, wherein said welding wire packer includes a capstan that pulls said welding wire, said laying head being rotatable and designed to receive said welding wire from the capstan and to direct said welding wire into said storage container.

33. The method as defined in claim 32, including the step of rotating said rotatable laying head in a forward direction for a period of time and in a reverse direction for a period of time while said welding wire is packed into said storage container.

34. The method as defined in claim 31, wherein said first and second time periods are the same.

35. The method as defined in claim 34, wherein said storage container support is rotated at least in said forward direction, then in said reverse direction, and then again in said forward direction while said welding wire is packed into said storage container.

36. The method as defined in claim 35, wherein said storage container support is rotated at a variable speed in said reverse direction.

37. The method as defined in claim 31, wherein said first time period is different from said second time period.

38. The method as defined in claim 37, wherein said storage container support is rotated at least in said forward direction, then in said reverse direction, and then again in said forward direction while said welding wire is packed into said storage container.

39. The method as defined in claim 38, wherein said storage container support is rotated at a substantially constant speed in said forward and said reverse direction.

40. The method as defined in claim 31, wherein said storage container support is rotated at a substantially constant speed in said forward and said reverse direction.

41. The method as defined in claim 31, wherein said storage container support is rotated in said forward direction at a different speed from said rotation in said reverse direction.

42. The method as defined in claim 41, wherein said storage container support is rotated in a repeating sequence of 0.1–100 rotations in said forward direction followed by 0.1–100 rotations in said reverse direction.

43. The method as defined in claim 42, wherein a number of rotations in said forward direction is substantially the same as a number of rotations in said reverse direction.

44. The method as defined in claim 31, wherein said storage container support is rotated at a variable speed in said forward direction.

45. The method as defined in claim 31, wherein said laying head feeds said welding wire at a substantially constant rate into said storage container.

46. The method as defined in claim 31, wherein said laying head feeds said welding wire at a variable rate into said storage container.

47. The method as defined in claim 31, wherein said storage container support is rotated in a repeating sequence of 0.1–100 rotations in said forward direction followed by 0.1–100 rotations in said reverse direction.

48. The method as defined in claim 47, wherein a number of rotations in said forward direction is substantially the same as a number of rotations in said reverse direction.

* * * * *